US008142898B2

(12) United States Patent
Carlson et al.

(10) Patent No.: US 8,142,898 B2
(45) Date of Patent: Mar. 27, 2012

(54) SMOOTH SURFACE MORPHOLOGY CHLORATE ANODE COATING

(75) Inventors: Richard C. Carlson, Euclid, OH (US); Kenneth L. Hardee, Middlefield, OH (US); Dino F. DiFranco, Mayfield Village, OH (US); Michael S. Moats, Holladay, UT (US)

(73) Assignee: De Nora Tech, Inc., Chardon, OH (US)

( * ) Notice: Subject to any disclaimer, the term of this patent is extended or adjusted under 35 U.S.C. 154(b) by 99 days.

(21) Appl. No.: 12/608,410

(22) Filed: Oct. 29, 2009

(65) Prior Publication Data

US 2010/0044219 A1 Feb. 25, 2010

Related U.S. Application Data

(62) Division of application No. 10/553,026, filed as application No. PCT/US2004/014357 on May 7, 2004, now Pat. No. 7,632,535.

(60) Provisional application No. 60/468,445, filed on May 7, 2003.

(51) Int. Cl.
*C25B 11/06* (2006.01)
*C25B 11/02* (2006.01)
*B32B 15/04* (2006.01)

(52) U.S. Cl. ..... 428/472; 204/290.12; 428/469; 428/646; 428/660; 428/655

(58) Field of Classification Search ..... None
See application file for complete search history.

(56) References Cited

U.S. PATENT DOCUMENTS

| | | | | |
|---|---|---|---|---|
| 3,234,110 | A | 2/1966 | Beer | |
| 3,265,526 | A | 8/1966 | Beer | |
| 3,632,498 | A | 1/1972 | Beer | |
| 3,711,385 | A | 1/1973 | Beer | |
| 3,776,834 | A * | 12/1973 | O'Leary | 204/290.13 |
| 3,855,092 | A | 12/1974 | O'Leary | |
| 3,882,002 | A | 5/1975 | Cook, Jr. | |
| 3,950,240 | A | 4/1976 | Cookfair et al. | |
| 4,005,004 | A | 1/1977 | Seko et al. | |
| 4,189,358 | A | 2/1980 | Borner et al. | |
| 4,272,354 | A | 6/1981 | de Nora et al. | |
| 4,297,195 | A * | 10/1981 | Sato et al. | 204/290.09 |
| 4,318,795 | A | 3/1982 | Bianchi et al. | |
| 4,528,084 | A | 7/1985 | Beer et al. | |
| 4,545,886 | A * | 10/1985 | de Nora et al. | 204/252 |
| 4,585,540 | A * | 4/1986 | Beer et al. | 204/290.09 |
| 5,167,788 | A | 12/1992 | Hardee et al. | |
| 5,578,176 | A * | 11/1996 | Hardee et al. | 204/290.08 |
| 6,368,489 | B1 * | 4/2002 | Hardee et al. | 205/578 |
| 6,527,924 | B1 | 3/2003 | Andolfatto et al. | |
| 6,527,939 | B1 * | 3/2003 | Hardee | 205/292 |
| 6,572,758 | B2 * | 6/2003 | Zolotarsky et al. | 205/503 |
| 6,802,948 | B2 * | 10/2004 | Hardee et al. | 204/290.14 |
| 7,247,229 | B2 * | 7/2007 | Hardee | 205/292 |
| 2002/0148736 | A1 | 10/2002 | Geusic et al. | |
| 2003/0068509 | A1 * | 4/2003 | Shah et al. | 428/472 |

FOREIGN PATENT DOCUMENTS

| | | |
|---|---|---|
| JP | 61052385 | 3/1986 |

OTHER PUBLICATIONS

Office Action dated Dec. 24, 2008 issued to U.S. Appl. No. 10/553,026.

Notice of Allowance dated Sep. 29, 2009 issued to U.S. Appl. No. 10/553,026.

* cited by examiner

*Primary Examiner* — Jennifer McNeil
*Assistant Examiner* — Vera Katz
(74) *Attorney, Agent, or Firm* — Eschweiler & Associates, LLC

(57) ABSTRACT

The present invention relates to an electrocatalytic coating and an electrode having the coating thereon, wherein the coating is a mixed metal oxide coating, preferably ruthenium, titanium and tin or antimony oxides. The coating uses water as a solvent that provides for a smoother surface than alcohol based solvents. The electrocatalytic coating can be used especially as an anode component of an electrolysis cell and in particular a cell for the electrolysis of aqueous chlor-alkali solutions.

11 Claims, No Drawings

SMOOTH SURFACE MORPHOLOGY CHLORATE ANODE COATING

RELATED APPLICATION

This application is a divisional patent application of application Ser. No. 10/553,026 filed Jul. 13, 2006, which is entitled "SMOOTH SURFACE MORPHOLOGY CHLORATE ANODE COATING", which is a §371 of PCT/US04/14357 filed May 7, 2004, which claims the benefit of U.S. Provisional Application No. 60/468,445 filed May 7, 2003, all of which are hereby incorporated by reference in their entirety.

BACKGROUND OF THE INVENTION

1. Field of the Invention

The invention is directed to an electrolytic electrode and a coating thereon having a smooth surface morphology which generates decreased amounts of oxygen for use in the electrolysis of aqueous chlor-alkali solutions.

2. Description of the Related Art

Electrode efficiency is an important consideration in various industrially important electrochemical processes, particularly where the electrode is utilized as an anode in a chlorine evolving process. Generally in these processes, the electrodes will contain a platinum-group oxide coating. These platinum group metal oxide coatings, such as are described in one or more of the U.S. Pat. Nos. 3,265,526, 3,632,498, 3,711,385, and 4,528,084 are most always alcohol-based, e.g., butanol.

For example, in U.S. Pat. No. 3,855,092, there is taught a method of electrolysis using an anode comprising an electrically conductive, particularly titanium, substrate at least partially covered with a solid solution-type coating consisting essentially of titanium, ruthenium and tin dioxides. The anode can find use in a mercury cell for the production of chlorine and caustic.

It would be desirable, however, to provide an electrode for service in chlorate electrolytic cells which provides improved efficiency and low oxygen generation while having improved lifetimes, without the necessity for an alcohol solvent.

SUMMARY OF THE INVENTION

There has now been found an electrode coating which provides improved lifetimes while maintaining high efficiencies. Additionally, the coating uses water as a solvent which provides a surface morphology having fewer surface cracks and thus lower oxygen generation which is especially beneficial in electrochemical cells wherein the oxidation of chloride to chlorine is the principal anode reaction.

DESCRIPTION OF THE INVENTION

The electrolytic process of the present invention is particularly useful in the chlor-alkali industry for the production of chlorate from a sodium chloride electrolyte. The electrode described herein when used in such process will virtually always find service as an anode. Thus, the word "anode" is often used herein when referring to the electrode, but this is simply for convenience and should not be construed as limiting the invention.

The metals for the electrode are broadly contemplated to be any coatable metal. For the particular application of an electrocatalytic coating, the metal might be such as nickel or manganese, but will most always be a "film-forming" metal.

By "film-forming metal" it is meant a metal or alloy which has the property that when connected as an anode in the electrolyte in which the coated anode is subsequently to operate, there rapidly forms a passivating oxide film which protects the underlying metal from corrosion by electrolyte, i.e., those metals and alloys which are frequently referred to as "valve metals", as well as alloys containing valve metal (e.g., Ti—Ni, Ti—Co, Ti—Fe and Ti—Cu), but which in the same conditions form a non-passivating anodic surface oxide film. Such valve metals include titanium, tantalum, aluminum, zirconium and niobium. Of particular interest for its ruggedness, corrosion resistance and availability is titanium. As well as the normally available elemental metals themselves, the suitable metals of the substrate include metal alloys and intermetallic mixtures, as well as ceramics and cermets such as contain one or more valve metals. For example, titanium may be alloyed with nickel, cobalt, iron, manganese or copper. More specifically, grade 5 titanium may include up to 6.75 weight percent aluminum and 4.5 weight percent vanadium, grade 6 up to 6 percent aluminum and 3 percent tin, grade 7 up to 0.25 weight percent palladium, grade 10, from 10 to 13 weight percent plus 4.5 to 7.5 weight percent zirconium and so on.

By use of elemental metals, it is most particularly meant the metals in their normally available condition, i.e., having minor amounts of impurities. Thus, for the metal of particular interest, i.e., titanium, various grades of the metal are available including those in which other constituents may be alloys or alloys plus impurities. Grades of titanium have been more specifically set forth in the standard specifications for titanium detailed in ASTM B 265-79. Because it is a metal of particular interest, titanium will often be referred to herein for convenience when referring to metal for the electrode base.

Plates, rods, tubes, wires or knitted wires and expanded meshes of titanium or other film-forming metals can be used as the electrode base. Titanium or other film-forming metal clad on a conducting core can also be used. It is also possible to surface treat porous sintered titanium with dilute paint solutions in the same manner.

Regardless of the metal selected and the form of the electrode base, before applying a coating composition thereto, the electrode base is advantageously a cleaned surface. This may be obtained by any of the treatments used to achieve a clean metal surface, including mechanical cleaning. The usual cleaning procedures of degreasing, either chemical or electrolytic, or other chemical cleaning operation may also be used to advantage. Where the base preparation includes annealing, and the metal is grade 1 titanium, the titanium can be annealed at a temperature of at least about 450° C. for a time of at least about 15 minutes, but most often a more elevated annealing temperature, e.g., 600° C. to 875° C. is advantageous.

When a clean surface, or prepared and cleaned surface, has been obtained, it can be advantageous to obtain a surface roughness. This will be achieved by means which include intergranular etching of the metal, plasma spray application, which spray application can be of particulate valve metal or of ceramic oxide particles, or both, and sharp grit blasting of the metal surface, optionally followed by surface treatment to remove embedded grit and/or clean the surface.

Etching will be with a sufficiently active etch solution to develop a surface roughness and/or surface morphology, including possible aggressive grain boundary attack. Typical etch solutions are acid solutions. These can be provided by hydrochloric, sulfuric, perchloric, nitric, oxalic, tartaric, and phosphoric acids as well as mixtures thereof, e.g., aqua regia. Other etchants that may be utilized include caustic etchants such as a solution of potassium hydroxide/hydrogen peroxide, or a melt of potassium hydroxide with potassium nitrate. Following etching, the etched metal surface can then be subjected to rinsing and drying steps. The suitable preparation of the surface by etching has been more fully discussed in U.S. Pat. No. 5,167,788, which is incorporated herein by reference.

In plasma spraying for a suitably roughened metal surface, the material will be applied in particulate form such as droplets of molten metal. In this plasma spraying, such as it would apply to spraying of a metal, the metal is melted and sprayed in a plasma stream generated by heating with an electric arc to high temperatures in inert gas, such as argon or nitrogen, optionally containing a minor amount of hydrogen. It is to be understood by the use herein of the term "plasma spraying" that although plasma spraying is preferred the term is meant to include generally thermal spraying such as magnetohydrodynamic spraying, flame spraying and arc spraying, so that the spraying may simply be referred to as "melt spraying" or "thermal spraying".

The particulate material employed may be a valve metal or oxides thereof, e.g., titanium oxide, tantalum oxide and niobium oxide. It is also contemplated to melt spray titanates, spinels, magnetite, tin oxide, lead oxide, manganese oxide and perovskites. It is also contemplated that the oxide being sprayed can be doped with various additives including dopants in ion form such as of niobium or tin or indium.

It is also contemplated that such plasma spray application may be used in combination with etching of the substrate metal surface. Or the electrode base may be first prepared by grit blasting, as discussed hereinabove, which may or may not be followed by etching.

It has also been found that a suitably roughened metal surface can be obtained by special grit blasting with sharp grit, optionally followed by removal of surface embedded grit. The grit, which will usually contain angular particles, will cut the metal surface as opposed to peening the surface. Serviceable grit for such purpose can include sand, aluminum oxide, steel and silicon carbide. Etching, or other treatment such as water blasting, following grit blasting can be used to remove embedded grit and/or clean the surface.

It will be understood from the foregoing that the surface may then proceed through various operations, providing a pretreatment before coating, e.g., the above-described plasma spraying of a valve metal oxide coating. Other pretreatments may also be useful. For example, it is contemplated that the surface be subjected to a hydriding or nitriding treatment. Prior to coating with an electrochemically active material, it has been proposed to provide an oxide layer by heating the substrate in air or by anodic oxidation of the substrate as described in U.S. Pat. No. 3,234,110. Various proposals have also been made in which an outer layer of electrochemically active material is deposited on a sublayer, which primarily serves as a protective and conductive intermediate. Various tin oxide based underlayers are disclosed in U.S. Pat. Nos. 4,272,354, 3,882,002 and 3,950,240. It is also contemplated that the surface may be prepared as with an antipassivation layer.

Following any of the foregoing techniques for surface preparation of the electrode base, an electrochemically active coating can then be applied to the substrate member. As representative of the applied electrochemically active coating, as such term is used herein, are those provided from platinum or other platinum group metals or they can be represented by active oxide coatings such as platinum group metal oxides, magnetite, ferrite, cobalt spinel or mixed metal oxide coatings. Such coatings have typically been developed for use as anode coatings in the industrial electrochemical industry. Suitable coatings of this type have been generally described in one or more of the U.S. Pat. Nos. 3,265,526, 3,632,498, 3,711,385, and 4,528,084. The mixed metal oxide coatings can often include at least one oxide of a valve metal with an oxide of a platinum group metal including platinum, palladium, rhodium, iridium and ruthenium or mixtures of themselves and with other metals. Further coatings include manganese dioxide, lead dioxide, cobalt oxide, ferric oxide, platinate coatings such as $M_x Pt_3O_4$ where M is an alkali metal and x is typically targeted at approximately 0.5, nickel-nickel oxide and nickel plus lanthanide oxides.

Representative coatings of the present invention will contain an element of ruthenium oxide in combination with titanium oxide and antimony or tin oxides. It is contemplated that the coating composition may optionally contain iridium oxide. The preferred coating compositions are those comprised of $RuCl_3$, $TiCl_3$, $SbCl_3$, and hydrochloric acid, all in aqueous solution. It has been found that, for the electrochemically active coating of the present invention, it is preferred that the coating formulation is prepared using a water base, as opposed to an alcohol base.

Such coating composition will contain sufficient ruthenium constituent to provide at least about 10 mole percent up to about 30 mole percent, and preferably from about 15 mole percent up to about 25 mole percent, basis 100 mole percent of the metal content of the coating. It will be understood that the constituents are substantially present as their oxides, and the reference to the metals is for convenience, particularly when referring to proportions.

A valve metal component will be included in the coating composition. Various valve metals can be utilized including titanium, tantalum, niobium, zirconium, hafnium, vanadium, molybdenum, and tungsten, with titanium being preferred. Salts of the dissolved metal are utilized, and suitable inorganic substituents can include chlorides, iodides, bromides, sulfates, berates, carbonates, acetates, and citrates, e.g., $TiCl_3$ or, $TiCl_4$, in acid solutions.

Such coating composition will contain sufficient Ti constituent to provide at least about 50 mole percent up to about 85 mole percent and preferably from about 60 mole percent up to about 75 mole percent, basis 100 mole percent of the metal content of the coating.

Where the coating composition will contain iridium oxide, suitable precursor substituents can include $IrCl_3$ or $H_2IrCL_6$. The iridium oxide will be present in an amount from about 1% mole percent up to about 25 mole percent, basis 100 mole percent of the metal content of the coating.

A preferred coating composition will contain antimony oxide. Suitable precursor substituents can include $SbCl_3$, $SbCl_5$, or other inorganic antimony salts. The antimony oxide will generally be present in an amount from about 5 mole percent up to about 20 mole percent and preferably from about 10 mole percent up to about 15 mole percent, basis 100 mole percent of the metal content of the coating.

As mentioned hereinbefore, it is also contemplated that the electrocatalytic coating can contain a tin oxide in place of or in addition to antimony oxide. Where tin oxide is the desired constituent, suitable precursor substituents can include $SnCl_2$, $SnSO_4$, or other inorganic tin salts. Where tin oxide is utilized, it will generally be present in an amount from about 2 mole percent up to about 20 mole percent and preferably from about 3 mole percent up to about 15 mole percent, basis 100 mole percent of the metal content of the coating.

In the coating composition of the invention, the ratio of ruthenium to antimony or tin will generally be from about 2:1 to about 0.1:1, and preferably about 1.5:1, with the ratio of titanium to antimony or tin being from about 19:1 to 1:1, and preferably about 5.7:1. Where the optional iridium component is utilized, the ratio of ruthenium to iridium will generally be from about 1:1 to about 99:1.

An important aspect of the present invention is that the coating composition is an aqueous-based composition. It has been found that such a composition provides a coating having a smooth surface morphology. The surface morphology is characterized by having minimal "mudcracks" which, in turn, form "islands" or "platelets" between the cracks. Generally, minimal can refer to either the number or depth of the cracks. It will be understood that the term "minimal" is used herein as a term of convenience and such term should not be construed as limiting the invention unless expressly stated herein as such. These characteristics, as measured by scanning electron microscopy (SEM), are more particularly described with reference to the Examples. It has been found that a coating having about less than or equal to 16,000 platelets per square millimeter (platelets/$mm^2$), and preferably from about 100 to about 12,000 platelets/$mm^2$, will provide a coating having enhanced efficiency and increased lifetime.

The electrocatalytic coating will be applied by any of those means which are useful for applying a liquid coating composition to a metal substrate. Such methods include dip spin and dip drain techniques, brush application, roller coating and spray application such as electrostatic spray. Moreover, spray application and combination techniques, e.g., dip drain with spray application can be utilized. With the above-mentioned coating compositions for providing an electrochemically active coating, a roller coating operation can be most serviceable.

Regardless of the method of application of the coating, conventionally, a coating procedure is repeated to provide a uniform, more elevated coating weight than achieved by just one coating. However, the amount of coating applied will be sufficient to provide in the range of from about 0.1 g/$m^2$ (gram per square meter) to about 30 g/$m^2$, and preferably, from about 0.25 g/$m^2$ to about 15 g/$m^2$, as total metal, per side of the electrode base.

Following application of the coating, the applied composition will be heated to prepare the resulting mixed oxide coating by thermal decomposition of the precursors present in the coating composition. This prepares the mixed oxide coating containing the mixed oxides in the mass proportions, basis the metals of the oxides, as above discussed. Such heating for the thermal decomposition will be conducted at a temperature of at least about 425° C. up to about 525° C. for a time of at least about 3 minutes up to about 20 minutes. Suitable conditions can include heating in air or oxygen. In general, the heating technique employed can be any of those that may be used for curing a coating on a metal substrate. Thus, oven coating, including conveyor ovens may be utilized. Moreover, infrared cure techniques can be useful. Following such heating, and before additional coating as where an additional application of the coating composition will be applied, the heated and coated substrate will usually be permitted to cool to at least substantially ambient temperature. Particularly after all applications of the coating composition are completed, postbaking can be employed. Typical postbake conditions for coatings can include temperatures of from about 450° C. up to about 525° C. Baking times may vary from about 30 minutes, up to as long as about 300 minutes.

As has been discussed hereinbefore, the coating of the present invention is particularly serviceable for an anode in an electrolytic process for the manufacture of chlorates. However, it is also contemplated that these electrodes may find use in other processes, such as the manufacture of chlorine, and hypochlorite or for oxidizing a soluble species, such as ferrous ion to form ferric ion.

EXAMPLE 1

A titanium plate sample of unalloyed grade 1 titanium, measuring 0.2 centimeters (cm) by 12.7 cm by 12.7 cm was grit blasted with alumina to achieve a roughened surface. The sample was then etched in a solution of 18-20% hydrochloric acid heated to 90-95° C. for approximately 25 minutes.

The titanium plate was then provided with an electrochemically active oxide coating as set forth in Table I. The coating solution was prepared by adding the amount of metals, as chloride salts, as listed in Table I, to a solution of 18% HCl containing 5 volume % isopropanol. After mixing to dissolve all of the salts, the solutions were applied to individual samples of prepared titanium plates. The coatings were applied in layers, with each coat being applied separately and allowed to dry at 110° C. for 3 minutes, followed by heating in air to 480° C. for 7 minutes. A total of 10 coats were applied to each sample. Following the final coat, the samples were post baked for 90 minutes at 460-490° C. Samples A & B are in accordance with the present invention. Sample C was prepared in alcohol solvent and is, therefore, considered a comparative example.

TABLE I

| | Amount of metal per liter of solution (gpl) | | | | Composition (mole %) | | | |
|---|---|---|---|---|---|---|---|---|
| Sample | Ru | Sn | Ti | Sb | Ru | Sn | Ti | Sb |
| Invention Sample A | 24.5 | | 42.8 | 19.3 | 18.7 | | 69.0 | 12.2 |
| Invention Sample B | 26.1 | 20.5 | 45.5 | | 18.8 | 12.2 | 69.0 | |
| Comparative Sample C | 26.1 | 20.5 | 45.5 | | 1 | | | |

The resulting samples were operated as anodes in a laboratory chlorate cell in an electrolyte that was 110 (gpl) grams per liter of NaCl, 475 gpl $NaClO_3$, and 4 gpl $Na_2Cr_2O_7$. The test cell was an unseparated cell maintained at 90° C. and operated at a current density of 3.0 kiloamps per square meter (kA/$m^2$). The results are summarized in Table II as the oxygen produced (in percent).

To compare the smoothness of the coatings a Scanning Electron Microscopy (SEM) photograph was taken of representative areas on the surface of each coating sample. Using a 1000× magnification picture, the number of platelets was counted for each sample. The results were then normalized to the real geometric area. The results are summarized in Table II as platelets per square millimeter (platelets/$mm^2$).

TABLE II

| Sample | Oxygen Generation (%) | Platelets/$mm^2$ |
|---|---|---|
| A | 1.4-1.6 | 6300 |
| B | 1.5-1.7 | 8800 |
| C | 3.0-3.5 | 25000 |

The samples were then operated as anodes in an accelerated test as an oxygen-evolving anode at a current density of 1 kA/$m^2$ in an electrochemical cell containing 150 g/l $H_2SO_4$ at 50° C. Cell voltage versus time data was collected every 30 minutes. The results are summarized in Table III as the elapsed time per amount of Ru before a given voltage rise.

TABLE III

| Sample | Accelerated Lifetime (hours per gram/$m^2$ of Ru) |
|---|---|
| A | 26 |
| B | 37 |
| C | 18 |

It is, therefore, evident from the results of Tables I & II that samples prepared according to the present invention have substantially decreased oxygen generation together with increased lifetime versus the comparison example.

While in accordance with the patent statutes, the best mode and preferred embodiment have been set forth, the scope of the invention is not limited thereto, but rather by the scope of the attached claims.

What we claim is:

1. A metal article of a valve metal substrate for use in electrocatalytic processes, said valve metal substrate having an electrocatalytic surface coating thereon, wherein said coating consists of a mixture of ruthenium oxide, titanium oxide and one or more of tin oxides or antimony oxides, said mixture providing from at least about 10 mole percent up to about 30 mole percent ruthenium, and at least about 50 mole percent up to about 85 mole percent titanium, basis 100 mole percent of metal oxide content in the coating, wherein a surface morphology of said coating is characterized by minimal mudcracks, said surface morphology obtained from a water-based coating composition wherein said surface morphology of said coating provides, as measured by scanning electron microscopy, from about less than or equal to 16,000 platelets/$mm^2$.

2. The metal article of claim 1, wherein said valve metal substrate is one or more of titanium, tantalum, zirconium, niobium, tungsten, aluminum, their alloys and intermetallic mixtures, and said substrate is in mesh, sheet, blade, tube or wire form.

3. The metal article of claim 2, wherein said ruthenium oxide is present in an amount from about 10 mole percent up to about 25 mole percent, and said titanium is present in an amount from about 60 mole percent up to about 75 mole percent, basis 100 mole percent of the metal content of the coating.

4. The metal article of claim 1, wherein a surface of said valve metal substrate is a prepared surface.

5. The metal article of claim 4, wherein said surface is prepared as by one or more of etching, intergranular etching, grit blasting, or thermal spraying.

6. The metal article of claim 1, wherein said coating contains from about 5 mole percent up to about 20 mole percent antimony oxide basis 100 mole percent of the metal content of the coating.

7. The metal article of claim 1, wherein said coating contains from about 2 mole percent up to about 20 mole percent tin oxide, basis 100 mole percent of the metal content of the coating.

8. The metal article of claim 1, wherein said coating contains from about 10 mole percent up to about 15 mole percent antimony oxide and from about 2 mole percent up to about 15 mole percent tin oxide, basis 100 mole percent of the metal content of the coating.

9. The metal article of claim 1, wherein a ratio of ruthenium metal to antimony or tin is from about 2:1 to about 0.1:1 and a ratio of titanium to antimony or tin is from about 19:1 to about 1:1.

10. The metal article of claim 1, wherein said surface morphology of said coating provides, as measured by scanning electron microscopy, from about 100 to about 12,000 platelets/$mm^2$.

11. The metal article of claim 1, wherein said electrode is an anode in an electrolytic process for the production of one or more of chlorine, chlorate, hypochlorite, or for the oxidation of a soluble species.

* * * * *